US007616528B2

(12) United States Patent
Meadows

(10) Patent No.: US 7,616,528 B2
(45) Date of Patent: Nov. 10, 2009

(54) LINEAR FLUID TIMEPIECE

(76) Inventor: Michael E. Meadows, 414 Barton Hill Rd., Schoharie, NY (US) 12157

( * ) Notice: Subject to any disclaimer, the term of this patent is extended or adjusted under 35 U.S.C. 154(b) by 405 days.

(21) Appl. No.: 11/720,919

(22) PCT Filed: Dec. 14, 2005

(86) PCT No.: PCT/US2005/045391

§ 371 (c)(1),
(2), (4) Date: Jun. 5, 2007

(87) PCT Pub. No.: WO2006/065976

PCT Pub. Date: Jun. 22, 2006

(65) Prior Publication Data

US 2009/0219789 A1 Sep. 3, 2009

Related U.S. Application Data

(60) Provisional application No. 60/636,282, filed on Dec. 15, 2004.

(51) Int. Cl.
*G04B 1/26* (2006.01)
*G04B 19/18* (2006.01)

(52) U.S. Cl. ..... 368/76; 368/65

(58) Field of Classification Search ..... 368/62, 368/65, 76, 93, 223, 276
See application file for complete search history.

(56) References Cited

U.S. PATENT DOCUMENTS

| | | | | | |
|---|---|---|---|---|---|
| 1,531,217 | A | | 3/1925 | Piatty | |
| 3,587,222 | A | | 6/1971 | Mestrovic | |
| 3,783,598 | A | | 1/1974 | Parr | |
| 3,875,736 | A | | 4/1975 | Gulko | |
| 4,028,877 | A | * | 6/1977 | Vatterott | 368/65 |
| 4,117,666 | A | * | 10/1978 | Aguilar | 368/91 |
| 4,161,098 | A | | 7/1979 | Ingendahl | |
| D256,891 | S | | 9/1980 | Diskin | |
| 4,262,348 | A | | 4/1981 | Hess | |
| 4,372,688 | A | * | 2/1983 | Chatten | 368/65 |
| 4,408,894 | A | * | 10/1983 | Hemperly | 368/93 |
| 5,077,705 | A | | 12/1991 | Anderson | |
| 5,331,609 | A | | 7/1994 | Gubin | |
| 7,245,561 | B2 | * | 7/2007 | Coleman | 368/65 |
| 2002/0145945 | A1 | | 10/2002 | Bucci | |

FOREIGN PATENT DOCUMENTS

GB 2371883 A 7/2002

* cited by examiner

*Primary Examiner*—Vit W Miska
(74) *Attorney, Agent, or Firm*—Jay R. Yablon

(57) ABSTRACT

The present invention provides a timepiece wherein the passage of time is represented by the movement of a fluid column from within an inner tube to a space between the inner tube and a concentric outer tube. In one embodiment, the timepiece includes a display mechanism adapted to adjust a fluid column height based on a capacitance proportional to the fluid column height.

20 Claims, 6 Drawing Sheets

LINEAR FLUID TIMEPIECE

CROSS-REFERENCE TO RELATED APPLICATIONS

This application claims the benefit of co-pending U.S. Provisional Application No. 60/636,282, filed 15 Dec. 2004, which is hereby incorporated herein.

BACKGROUND OF THE INVENTION (1) Technical Field

The present invention relates generally to timepieces and more particularly to timepieces having a linear scale, wherein the passage of time is represented by the rising or falling of a fluid column.

(2) Related Art

Various timepieces having linear scales are known in the art. For example, U.S. Pat. No. 5,331,609 to Gubin and U.S. Pat. No. 3,875,736 to Gulko describe timepieces having linear scales and belt-driven, non-fluid indicators. U.S. Pat. Nos. 3,783,598 to Parr and 4,262,348 to Hess describe timepieces having fluid-filled tubes adjacent a linear scale, wherein movement of fluid within the tubes represents the passage of time. Each of these devices, however, suffers from the deficiency that they can be read from a maximum of two positions (i.e., a position facing the time scale and possibly a second position opposite the first) and can often only be read from one position. In addition, the Parr device must utilize piston pumps that are small enough so as not to make the device too large to be useful. In order to utilize the smaller fluid reservoir of these piston pumps, the fluid-filled tubes of the Parr device must be thin capillary tubes. The size of these tubes further reduces the readability and utility of the Parr device.

United Kingdom Patent Application 2,371,833 to Coleman describes a device having two concentric, clear, fluid-filled tubes in which the heights of dynamic vortices formed within the tubes represent the passage of time. Such a device requires a great deal of energy, particularly in the formation of the vortices, and is therefore impractical for use as a personal timepiece. Furthermore, this device requires a large base-mounted or external sump for fluid transfers. Accordingly, there is a need in the art for a timepiece having a linear scale, wherein the disadvantages of the prior art devices above are avoided.

SUMMARY OF THE INVENTION

The present invention provides a timepiece wherein the passage of time is represented by the movement of a fluid column from within an inner tube to a space between the inner tube and a concentric outer tube. In one embodiment, the timepiece includes a display mechanism adapted to adjust a fluid column height based on a capacitance proportional to the fluid column height.

A first aspect of the invention provides timepiece comprising: a base member; an inner tube; an outer tube; a time scale; a timing mechanism; and a display mechanism, wherein a passage of time is measured by the timing mechanism and represented by the display mechanism moving a fluid column from a reservoir within the inner tube to a space between the inner tube and the outer tube.

A second aspect of invention provides timepiece comprising: a base member; an inner tube; an outer tube; a time scale; a timing mechanism; and an open loop display mechanism, wherein a passage of time is measured by the timing mechanism and represented by the display mechanism moving a fluid column from a reservoir within the inner tube to a space contained between the inner tube and the outer tube using a piston.

A third aspect of invention provides a method for displaying a passage of time, comprising: measuring a passage of time; moving a fluid column from an area within a first tube to an area between the first tube and a second tube; and correlating a height of the fluid column to the passage of time.

The foregoing and other features of the invention will be apparent from the following more particular description of embodiments of the invention.

BRIEF DESCRIPTION OF THE DRAWINGS

The embodiments of this invention will be described in detail, with reference to the following figures, wherein like designations denote like elements, and wherein.

DETAILED DESCRIPTION OF THE INVENTION

Figure 1B:
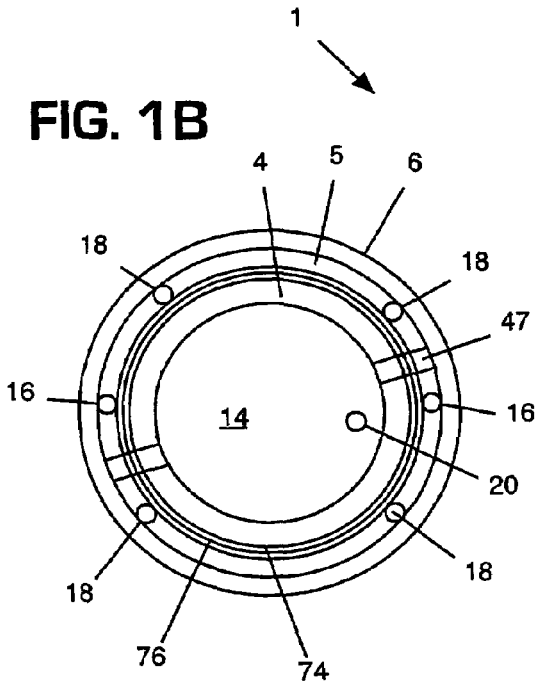
FIGS. 1A-1B show side and top cross-sectional views of a timepiece having a capacitance-based fluid height feedback display mechanism according to the invention.
Figure 1A:
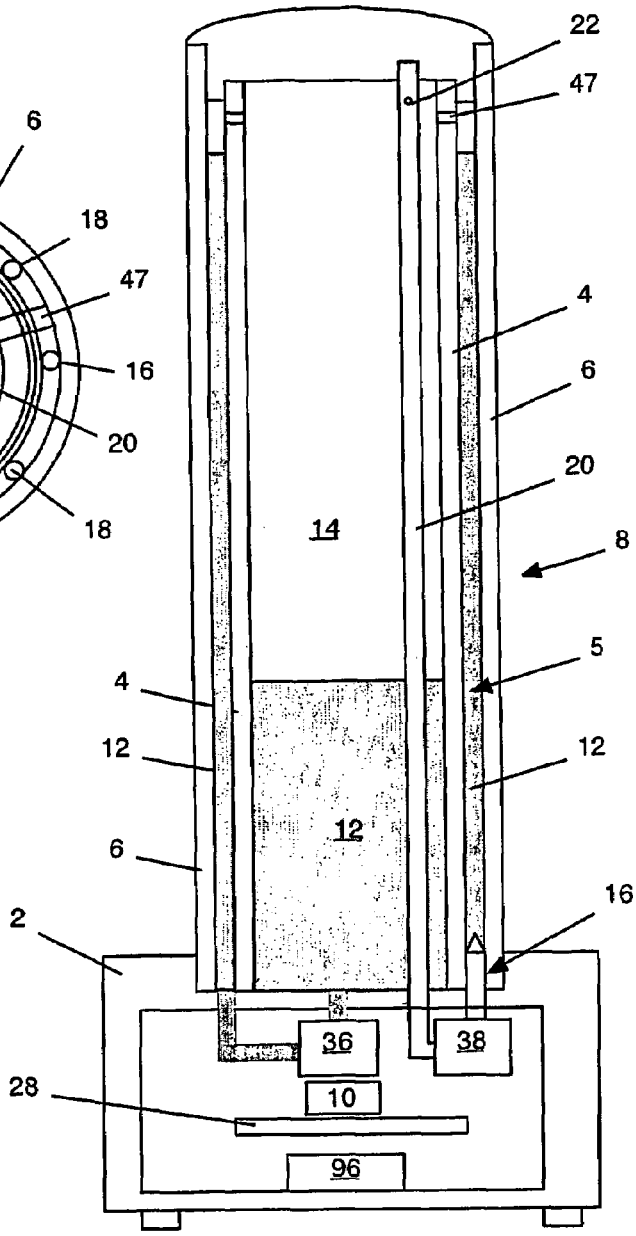

Referring to FIGS. 1A-1B, side and top cross-sectional views are shown of a timepiece according to the present invention. Generally, the present invention is a vertically-oriented, linear timepiece 1 having two concentric tubes 4, 6. Fluid 12 stored within inner tube 4 is pumped into an annular space 5 between the inner tube 4 and the outer tube 6 to reflect the current time proportional to fluid height. In a preferred embodiment, inner tube 4 is opaque and outer tube 6 is transparent. Outer tube 6 may also be translucent.

Time is kept by internal digital circuit 28. Based upon the output from the circuit, fluid level system 36 feeds fluid 12 from within reservoir 14 to reside between inner tube 4 and outer tube 6. Time is read based on the height of the fluid against a reference scale marked on the device. Generally, the level of the fluid will rise with the passage of time, although other embodiments are possible, such as a falling fluid marking the passage of time.

As noted above, in a preferred embodiment, inner tube 4 is opaque, while outer tube 6 is transparent or translucent. Accordingly, the excess display fluid 12 is invisibly stored in reservoir 14 (sump) contained by inner tube 4 that is coaxial with translucent outer tube 6 to avoid the need for a base-mounted sump or an external sump. This allows for a sealed, compact, personal sized timepiece wherein only a timer, driver, and battery 96 may be contained in the base. The present invention uses the relatively larger volume available within the inner tube as a sump, while no fluid is stored in the base or externally. In a preferred embodiment the concentric tubes are rounded so that time can be read from virtually any direction. However, it should be understood that any number of shapes are possible.

Figure 2:
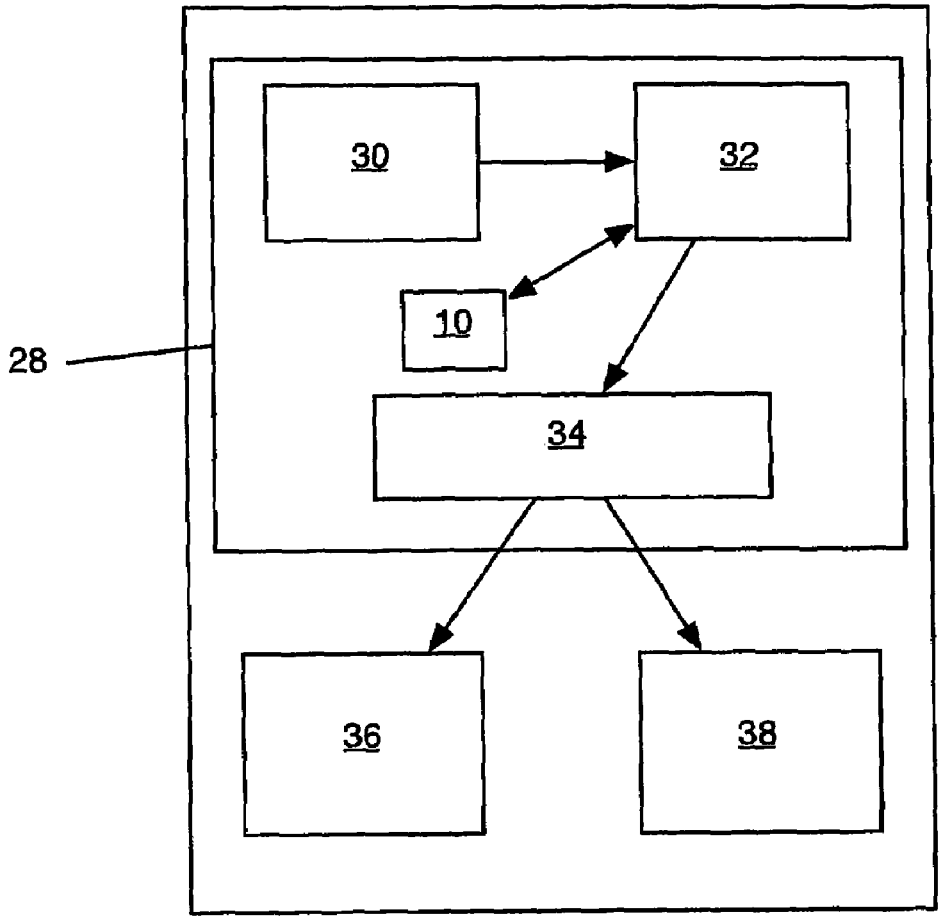
FIG. 2 shows an exemplary wiring schematic of a timepiece having a capacitance-based fluid height feedback display mechanism according to the invention.

Referring to FIGS. 1A, 1B, and 2, the structure of timepiece 1 will be further described. Timepiece 1 comprises base member 2 connected to inner tube 4 and outer tube 6; a time scale (shown in FIGS. 5-6); timing mechanism 10; and display mechanism 8, wherein passage of time is measured by timing mechanism 10 and represented by display mechanism 8 moving an electrically conductive fluid 12 from reservoir 14 within inner tube 4 to an annular space 5 contained between inner tube 4 and outer tube 6. In the embodiment of FIGS. 1A-B, non-conductive inner tube 4 is coated with conductive outer layer 74. Conductive outer layer 74 further includes and is electrically isolated by a non-conductive thin dielectric coating 76. Non-conductive coating 76 is positioned to make contact with the conductive display fluid contained between inner tube 4 and outer tube 6.

In the embodiment of FIGS. 1A-B, capacitance of the circuit between conductive layer 74 and the conductive fluid 12 is proportional to a height of the fluid displayed. More particularly, capacitance is measured across the non-conductive thin dielectric coating 76 coating the outside diameter of a conductive inner tube electrode 74. The electrically conductive fluid 12 serves as a moving electrode to develop a varying capacitive sensing across the dielectric capacitor coating 76. In a preferred embodiment, the fluid has a resistance low enough relative to total circuit resistance to avoid significant resistor capacitor (RC) time constant circuit error. The voltage signal has a frequency or time constant that increases or decreases depending on the capacitance height of the fluid, which is correlated to the height of the fluid. In an alternative embodiment, an alternative capacitance sensing method includes a non-conductive dielectric fluid between two electrode plates or concentric tubes with a separation distance=d.

The capacitance height of the fluid circuit is compared to internal digital circuit 28 to determine an actual fluid height contained between inner tube 4 and outer tube 6. As shown, display mechanism 8 of the timepiece 1 of FIG. 1A comprises display pump mechanism 36 used to pump the fluid to a time proportional level and internal digital circuit 28 for measuring capacitance determined by the fluid height residing between inner tube 4 and outer tube 6, the capacitance being proportional to a height of the fluid, which is in turn calibrated to timing mechanism 10 for recording the passage of time. The resulting capacitance is measured as a fluid level to clock feedback in a time display mode, but may also be tracked as the clock circuit's setpoint in timeset mode, wherein a user manually sets the fluid display level. Preferably, the timing mechanism is an electronic clock device, although other mechanisms may be similarly used. Tracking during set mode is an optional but desirable feature. The fluid height feedback apparatus described above permits the use of a non-precision fluid pump. Other methods of providing fluid height feedback may be similarly be employed, as would be recognized by one skilled in the art.

In some cases, the fluid level contained between inner tube 4 and outer tube 6 may not accurately match the correct internal time. Before the fluid level would appear inaccurate to a user viewing the timepiece, display pump mechanism 36 transfers fluid 12 between reservoir 14 and the space between inner tube 4 and outer tube 6 to correct the visual inaccuracy of the level. Therefore, by comparing the capacitance to internal digital timer 10, display pump mechanism 36 adjusts the height of the fluid contained between inner tube 4 and outer tube 6.

Referring to FIG. 2, a block diagram of an exemplary wiring schematic of a timepiece having a capacitance-based display feedback according to the invention is shown. FIG. 2 is similarly applicable to any other feedback or level-sensing method or mechanism. As described above, the capacitive sensing voltage signal has a frequency decay time constant that increases or decreases depending on the capacitance of the RC circuit, which is proportional to the height of the fluid. Generally, the fluid display height feedback or level-sensing signal is compared to internal digital timer 10. Digital circuit board 28 comprises timer 10, level sensing circuit 30, digital comparator 32, and control logic 34. However, it should be recognized that internal digital circuit 28 may include any number of configurations with varying complexity, as will be further described below.

During operation, capacitance level sensing circuit 30 receives an RC feedback signal from the electrodes. This input is converted from an analog signal to a digital signal and sent to digital comparator 32, which allows digital timer 10 to track the fluid in the timeset mode. An analog comparator may similarly compare a digital-to-analog output of digital timer 10 to the fluid level in a timing mode. Next, the signal is sent to digital controller 34. Digital timer 10 represents the internal digital time for the present invention. Digital timer 10 according to a preferred embodiment contains a one pulse-per-second (PPS) clock reference and a 12-hour pulse preset counter. Internal digital circuit 28, and in particular digital controller 34, controls display pump mechanism 36 and optional bubble pump system 38. The signal sent from digital controller 34 to display pump mechanism 36 determines the direction of flow between reservoir 14 within inner tube 4 and the space contained between inner tube 4 and outer tube 6. In a preferred embodiment, display pump mechanism 36 comprises a pump driver (with or without motion feedback), reversible motor, and a pump which forces the fluid to either reservoir 14 or the space between inner tube 4 and outer tube 6.

The timepiece of FIGS. 1A-B and 2 also includes an optional bubbling mechanism, whereby a bubble of air is periodically released into the fluid between inner tube 4 and outer tube 6 to indicate that the timepiece is functioning. During operation, snorkel 20 receives air through snorkel intake 22 and delivers the air to bubble nozzle 16. As mentioned above, internal digital circuit 28, and in particular digital controller 34, controls bubble pump system 38. As such, bubble pump system 38 can be used to mark additional units of time, generally shorter in duration than those units marked by the fluid tube, such as seconds, minutes, or multiples of seconds or minutes. Bubble pump system 38 comprises a driver (with or without motion feedback), motor, and an air pump to deliver air from snorkel 20 to bubble nozzle 16. In preferred embodiments, bubbles rise at 1 minute intervals under direct current (DC) power or 10 second intervals under alternating current (AC) power to add visual interest. The less frequent release of bubbles under DC power is effective to conserve power and therefore prolong battery 96 life.

As shown in FIG. 1B, lighting device(s) 18 may be used to add a column of light into the fluid tube to enhance the visual appearance of bubbles and/or the legibility of the fluid level. Preferably, lighting device 18 includes one or more light emitting diodes (LEDs) located in the base of the timepiece, whereby light is shone upward through the fluid column. Such lighting devices may optionally provide colored light.

Figure 3:
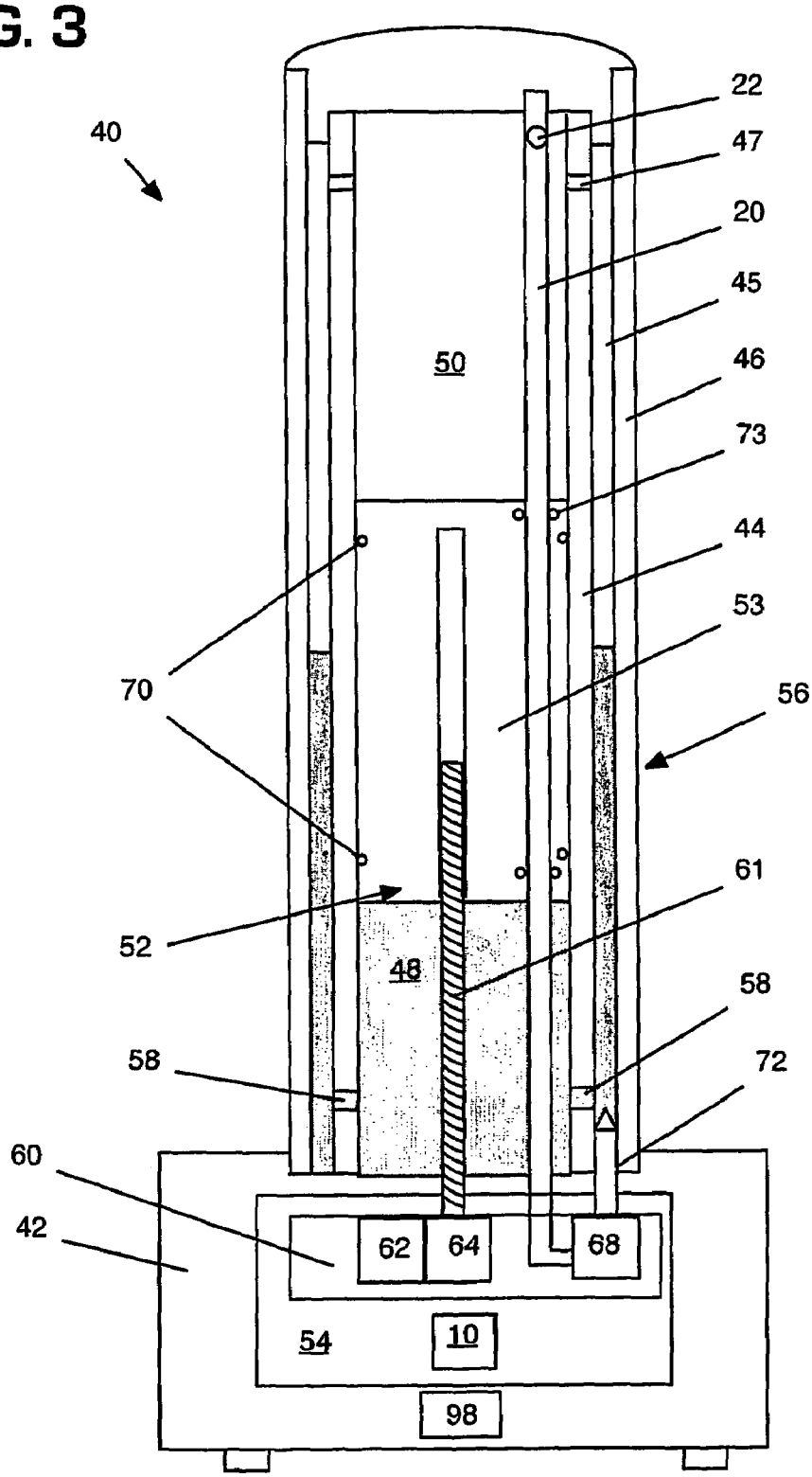
FIG. 3 shows a side cross-sectional views of a timepiece having a one-stroke displacement piston-based fluid metering display mechanism according to the invention.

Referring now to FIG. 3, a timepiece similar to that of FIGS. 1A-1B is depicted. However, unlike the timepiece of FIGS. 1-2, where the fluid display height was sensed by electrical capacitance (or another feedback method), the display mechanism shown in FIG. 3 is a single-stroke piston-based pump without a level-sensing feedback signal. In this embodiment, timepiece 40 comprises: base member 42; inner tube 44 and outer tube 46; a time scale (shown in FIGS. 5-6);

timing mechanism 54; and display mechanism 56, wherein a passage of time is measured by timing mechanism 54 and represented by display mechanism 56 moving a fluid from reservoir 50 within inner tube 44 to an annular space 45 contained between inner tube 44 and the outer tube 46 using piston pump 52. That is, the movement of fluid from within inner tube 44 to the space between inner tube 44 and outer tube 46 is achieved by a piston-mechanism capable of exerting pressure onto fluid 48 within inner tube 44, which in turn forces the fluid through fluid transfer holes 58 and into the inter-tube space. In a preferred embodiment, inner tube 44 is primarily metal-based while outer tube 46 is glass or plastic (e.g., polymer-based). This offsets the liquid temperature expansion. Also, in a preferred embodiment, inner tube 44 is substantially opaque and outer tube 46 is one of: translucent and transparent.

Referring again to FIG. 3, a method for measuring the passage of time according to the present invention will be further described. In this embodiment, piston pump 52 generally comprises a threaded shaft 61 connected to a piston 53. Piston movement is controlled by liquid level system 60, wherein liquid level system 60 comprises a level drive motor 62 with a rotary encoder, and level drive gears 64 coupled to the threaded piston drive shaft 61. Positive displacement metering piston pump 52 is a hydraulic-based piston operating axially within inner tube 44. In a preferred embodiment, liquid 48 resides below piston 53 and the rest of reservoir 50 above piston 53 is filled with air. Piston 53 is secured against leakage by piston rod seal(s) 70. The downstroke movement of piston 53 forces fluid 48 through fluid transfer holes 58. If piston 53 is moving upward in tube 44, a vacuum created within reservoir 50 draws fluid 48 from the space between inner tube 44 and outer tube 46 into reservoir 50 beneath piston 53.

During operation, fluid mechanism 54 controls the operation of level drive motor 62 and the revolution count of level drive gears 64. This embodiment contains no level detection feedback circuitry other than a cumulative count of the piston drive motor position via an angular encoder and position switch or detector to indicate piston is "full down" and/or "full up" during reset cycle, when air is purged from the reservoir 50. In a "full up" position, piston 53 clears fluid 48 from reservoir 50 via vents 47. Fluid display mechanism 54 determines the distance piston 53 moves through reservoir 50 and as a result, the level to which fluid 48 rises in the space between inner tube 44 and outer tube 46.

Figure 4:
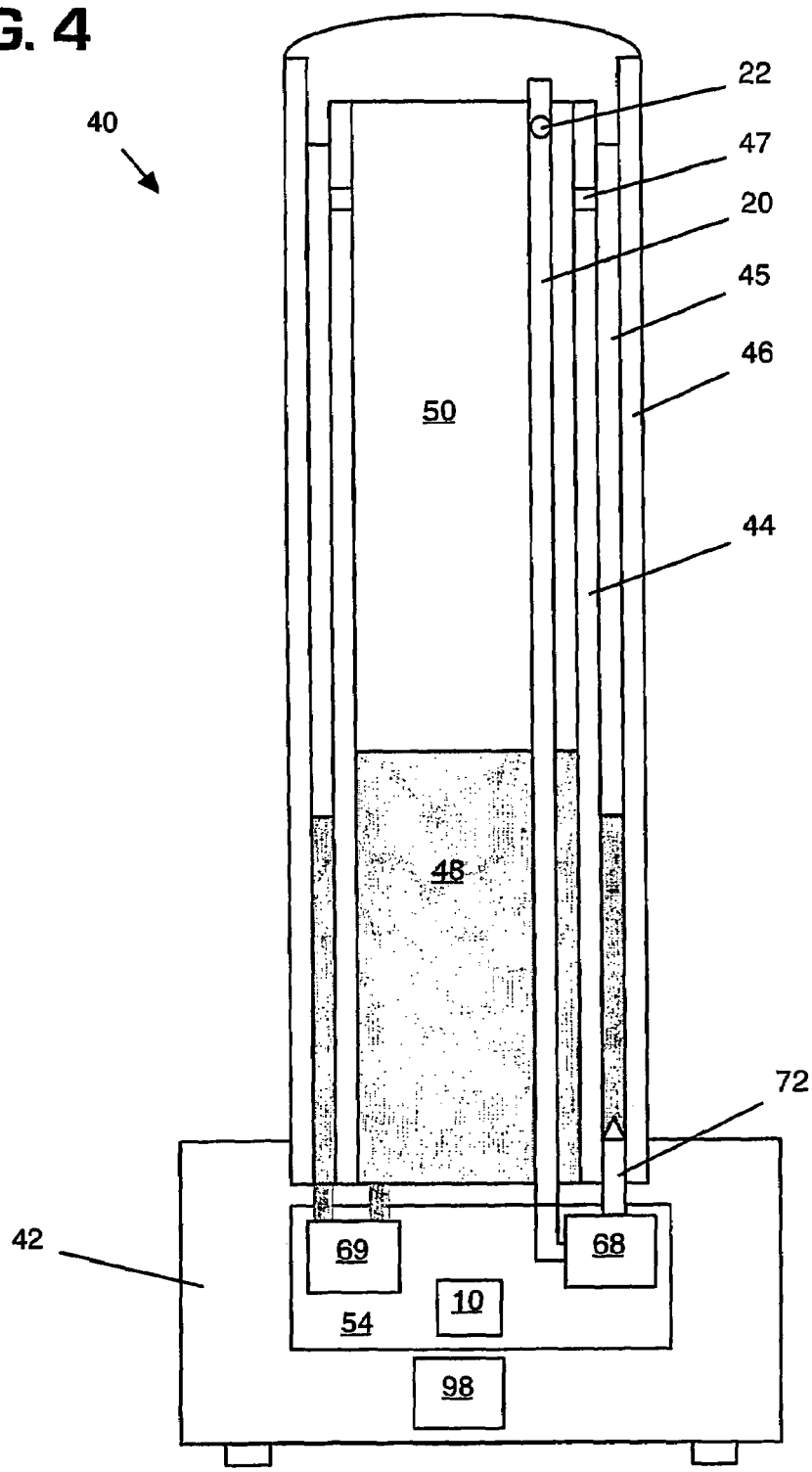
FIG. 4 shows a side cross-sectional view of a timepiece having a precision metering pump according to the invention.

Furthermore, in an alternative embodiment shown in FIG. 4, it is possible to use a precision metering pump 69, such as a twin gear, lobe, or other continuous-motion positive-displacement pump. Such a device would run "open loop," without a fluid level display feedback. Accuracy within a given period (e.g., 12 or 24 hours) would therefore depend upon the pump's precision. Cumulative display error is avoided by resetting the fluid height to a fixed or detectable reset height at periodic intervals (e.g., every 12 or 24 hours). Such an embodiment may increase durability and power efficiency over a multi-stroke piston type of pump, for longer battery 98 life.

Timepiece 40 of FIGS. 3-4 may also include an optional bubbling mechanism 68, whereby a bubble of air is periodically released from bubble nozzle 72 into the fluid between inner tube 44 and outer tube 46. As such, the bubble of air can be used to mark additional units of time, generally shorter in duration than those units marked by the fluid tube, such as seconds. Fluid mechanism 54 controls the release of bubbles from bubble nozzle 72. In the event that a bubbling mechanism 68 is employed, snorkel seal(s) 73 prevent leakage of fluid and/or entrapment of air as piston head 53 rises and falls. Vents 47 allow equalization of pressures between inner tube 44 and outer tube 46 as fluid 48 is displaced from reservoir 50 to annular space 45 or vice versa.

As can be seen from both FIGS. 1A, 3, and 4, the mechanisms of each timepiece may be powered by battery source 96 and 98 respectively. The timepieces of the present invention require relatively little power, making them useful as desktop or tabletop devices. Optionally, the timepieces of the present invention may be powered by alternating current (AC).

Additionally, it is possible for the timepiece of the present invention to be made with two liquids that are not miscible in each other. In one such embodiment, one liquid is clear and the other liquid colored or non-clear. Accordingly, the fluid interface line between the two fluids demarks the time level. Using two liquids, as opposed to a liquid and air, reduces the differential pressure head that the pump must work against, thus reducing the power needed to operate it. The use of two (or more) immiscible liquids further enables the use of a rising or falling droplet of one liquid through a column of another liquid, as described above with respect to the optional bubbling mechanism.

As will be recognized by one skilled in the art, other mechanisms or methods of measuring a level of and/or displacing a fluid are known and could be employed in an embodiment of the invention. Generally, such mechanisms or methods are one of two types: "open loop," utilizing a precision metering pump, and "closed loop," utilizing level-sensing feedback. Examples of "open loop" mechanisms and methods include, for example, a multi-stroke positive-displacement metering piston pump, and a displacer metering piston. Examples of "closed loop" mechanisms and methods include, for example, capacitance measurement, differential pressure measurement; force balance measurement, using a displacer float having a force transducer; magnetorestrictive float measurement; sonar measurement of a linear height of the fluid; measurement of the fluid column's electrical resistance, and a height-sensing electrode array.

Figure 5:
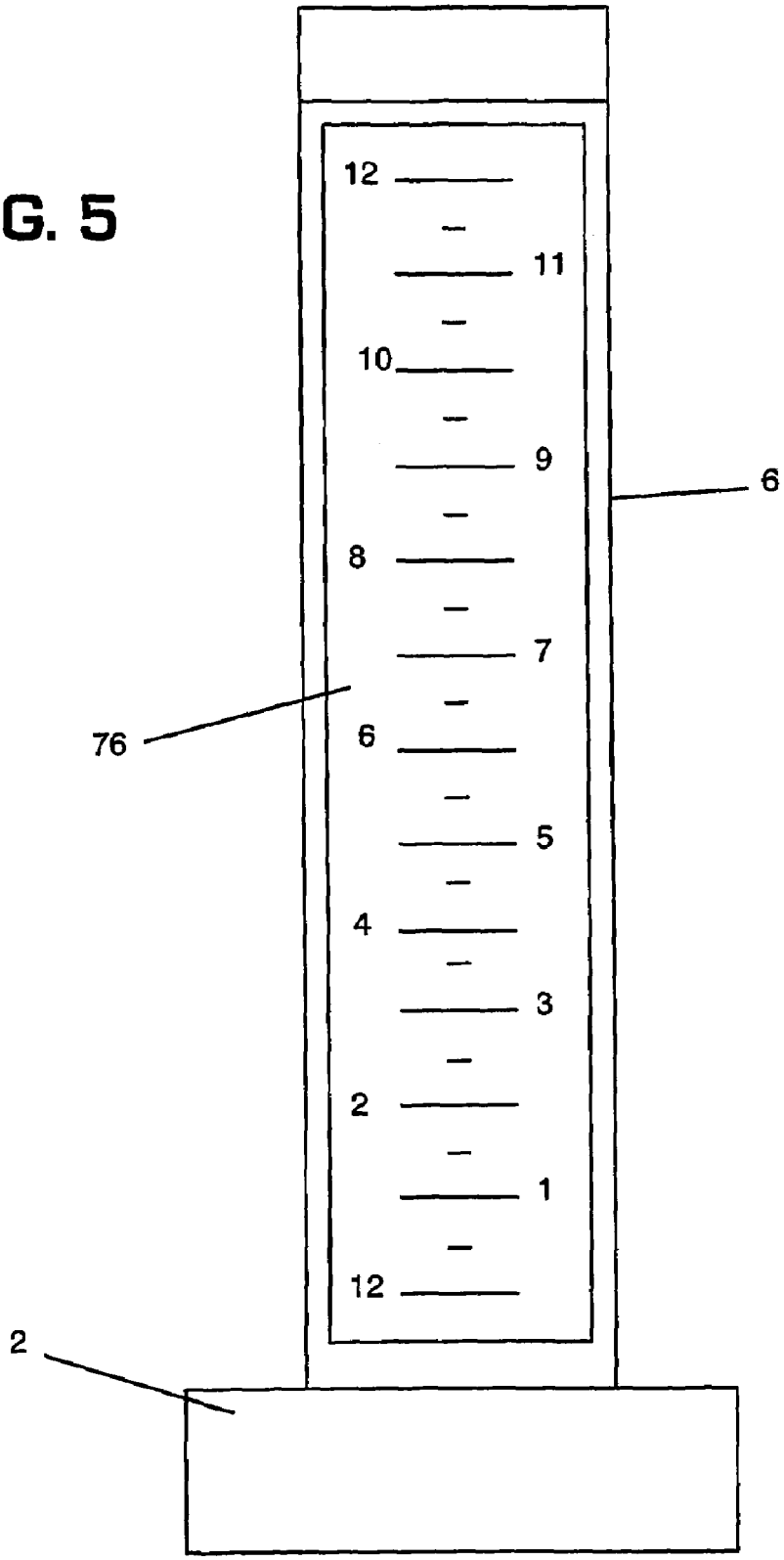
FIG. 5 shows a side view of a timepiece having a vertical, linear Arabic scale according to the invention.
Figure 6:
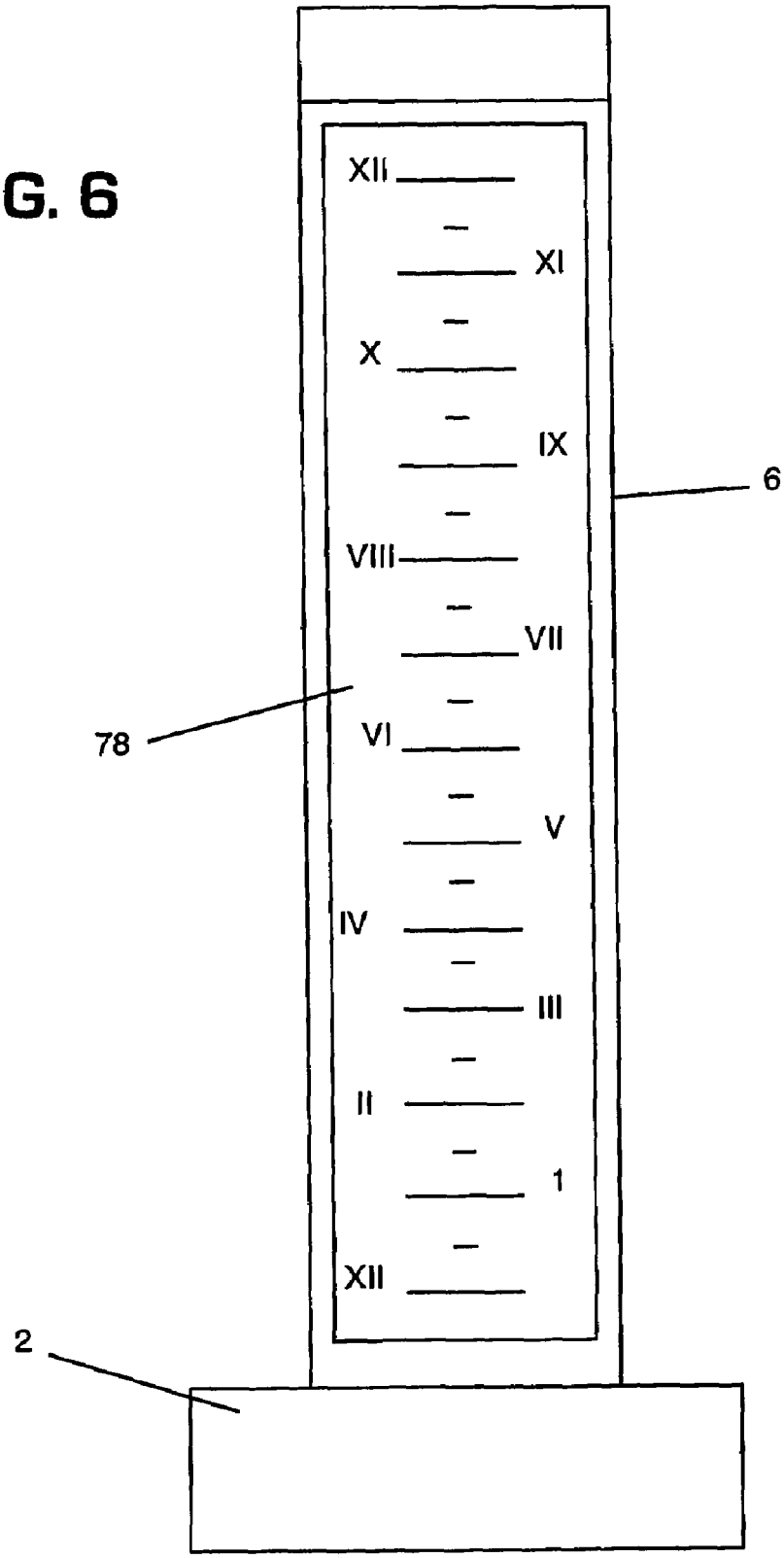
FIG. 6 shows a side view of a timepiece having a vertical, linear Roman scale according to the invention.

FIGS. 5 and 6 show side views of alternate embodiments of two scales useful in the timepieces of the present invention. FIG. 5 depicts vertical, linear, Arabic scale 76, while FIG. 6 depicts vertical, linear, Roman scale 78. However, it should be appreciated that any number of different scales may be used. In addition, it may be desirable to include more than one scale of the same or different types on a single tube. Such an arrangement would aid a user in reading the timepiece from a number of locations around its periphery.

While this invention has been described in conjunction with the specific embodiments outlined above, it is evident that many alternatives, modifications and variations will be apparent to those skilled in the art. Accordingly, the embodiments of the invention as set forth above are intended to be illustrative, not limiting. Various changes may be made without departing from the spirit and scope of the invention as defined in the following claims.

What is claimed is:

1. A timepiece comprising:

a base member;

an inner tube;

an outer tube;

a time scale;

a timing mechanism; and a display mechanism, wherein a passage of time is measured by the timing mechanism and represented by the display mechanism moving a fluid column from a reservoir within the inner tube to a space between the inner tube and the outer tube.

2. The timepiece of claim 1, wherein the display mechanism includes at least one closed loop mechanism selected from a group consisting of: a capacitance measuring device, a differential pressure measuring device, a force balance measuring device, a magnetorestrictive float measuring device, a sonar measuring device, a liquid resistance measuring device, and a height-sensing electrode array.

3. The timepiece of claim 2, wherein the display mechanism includes a capacitance measuring device adapted to adjust a height of fluid column according to a capacitance proportional to a height of the fluid column.

4. The timepiece of claim 3, wherein the capacitance is proportional to a height of the fluid column.

5. The timepiece of claim 1, wherein the fluid column comprises a first fluid and a second fluid immiscible in the first fluid.

6. The timepiece of claim 1, wherein the inner tube is substantially opaque and the outer tube is one of: translucent and transparent.

7. The timepiece of claim 1, further comprising:

means for releasing at least one of the following within the fluid column: a bubble of a gas and a drop of an immiscible fluid.

8. The timepiece of claim 1, further comprising at least one lighting device adapted to shine a light within the fluid column.

9. A timepiece comprising:

a base member;

an inner tube;

an outer tube;

a time scale;

a timing mechanism; and an open loop display mechanism, wherein a passage of time is measured by the timing mechanism and represented by the display mechanism moving a fluid column from a reservoir within the inner tube to a space contained between the inner tube and the outer tube using a piston.

10. The timepiece of claim 9, wherein the open loop display mechanism includes at least one of the following: a single-stroke positive displacement metering piston pump, a multi-stroke positive displacement metering piston pump, and a displacer metering piston.

11. The timepiece of claim 9, wherein the timing mechanism comprises:

a liquid level system; and an internal digital drive circuit.

12. The timepiece of claim 9, wherein the fluid column comprises a first fluid and a second fluid immiscible in the first fluid.

13. The timepiece of claim 9, wherein the inner tube is substantially opaque and the outer tube is one of: translucent and transparent.

14. The timepiece of claim 9, further comprising:

means for releasing at least one of the following within the fluid column: a bubble of a gas and a drop of an immiscible fluid.

15. The timepiece of claim 9, wherein passage of time is further represented by periodically releasing within the fluid column at least one of the following: a bubble of a gas and a drop of an immiscible fluid.

16. The timepiece of claim 9, further comprising a rotary positive displacement pump.

17. A method for displaying a passage of time, comprising:

measuring a passage of time with a timing mechanism;

moving a fluid column with a timing mechanism from an area within a first inner tube to an area between the first inner tube and a second outer tube; and correlating a height of the fluid column to the passage of time.

18. The method of claim 17, wherein the correlating step includes measuring a capacitance proportional to a height of the fluid column between the first tube and the second tube.

19. The method of claim 17, wherein the correlating step includes at least one of the following:

comparing a position of a piston moving the fluid to a measured time and comparing a number of rotations of a rotary positive displacement metering pump to a passage of time.

20. The method of claim 17, further comprising the step of releasing a bubble into the fluid column between the first tube and the second tube.

* * * * *